United States Patent [19]

Vitale

[11] Patent Number: 4,498,586

[45] Date of Patent: Feb. 12, 1985

[54] PACKAGE SAVER

[76] Inventor: Carmela Vitale, 1076 Carll Straight Path, Dix Hills, N.Y. 11746

[21] Appl. No.: 465,642

[22] Filed: Feb. 10, 1983

[51] Int. Cl.[3] ..... B65D 85/72

[52] U.S. Cl. ..... 206/525; 426/124; 426/128; 206/45.32; 206/541

[58] Field of Search ..... 206/525, 527, 45.32, 206/541, 551; 229/36, 33; 426/128, 124; 215/231; 248/346

[56] References Cited

U.S. PATENT DOCUMENTS 1,357,155 10/1920 Dinkins ..... 215/231

2,452,629 11/1948 Bonekamp ..... 426/128

2,928,537 3/1960 Stagner ..... 426/124

3,180,739 4/1965 Stoker ..... 426/124

*Primary Examiner*—William T. Dixson, Jr.

*Attorney, Agent, or Firm*—Stoll, Wilkie, Previto & Hoffman

[57] ABSTRACT

A temperature resistant molded plastic device is described for use in boxes or packages such as pizza boxes where there is a tendency of large cover portions to sag downwardly to damage the soft pizza or other packaged products. In use, the saver is positioned near the center of the package to support the box cover for protecting the contents.

4 Claims, 4 Drawing Figures

PACKAGE SAVER

BACKGROUND OF THE INVENTION

The present invention relates to a package saver or device for improving the packaging of soft products which may be damaged in boxes or cartons with relatively large sagging covers.

More particularly, the invention relates to such a package saver which is molded from plastic to have minimal size, weight, and cost and which is suitable for supporting large carton covers such as those used for pizza pies. The molded plastic saver is positioned centrally of the completed pie or other product to support the cover during storage and delivery.

The package saver is useful in connection with the delivery of products which require a package, but whose cost necessarily requires a relatively inexpensive and disposable box or carton. Cartons of this type, and particularly those used to deliver pizza pies or large cakes or pies, comprise boxes with relatively large covers formed of inexpensive board material.

Due to the quality of the board and their large size, there is a tendency of the covers to sag or to be easily depressed at their center portions so that they may damage or mark the pies or cakes during storage or delivery.

Accordingly, an object of the present invention is to provide an easily manufactured, relatively inexpensive, lightweight article which is placed on the pie or cake within the package to support the central portion of the package cover during delivery.

Another object of the present invention is to provide an improved means for protecting articles such as pizza and other pies or cakes from damage during delivery in boxes.

Another object of the present invention is to provide an inexpensive device for protecting pizza and other pies or cakes during delivery.

Other and further objects of the present invention will become apparent upon an understanding of the illustrative embodiments about to be described, or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

Figure 1:
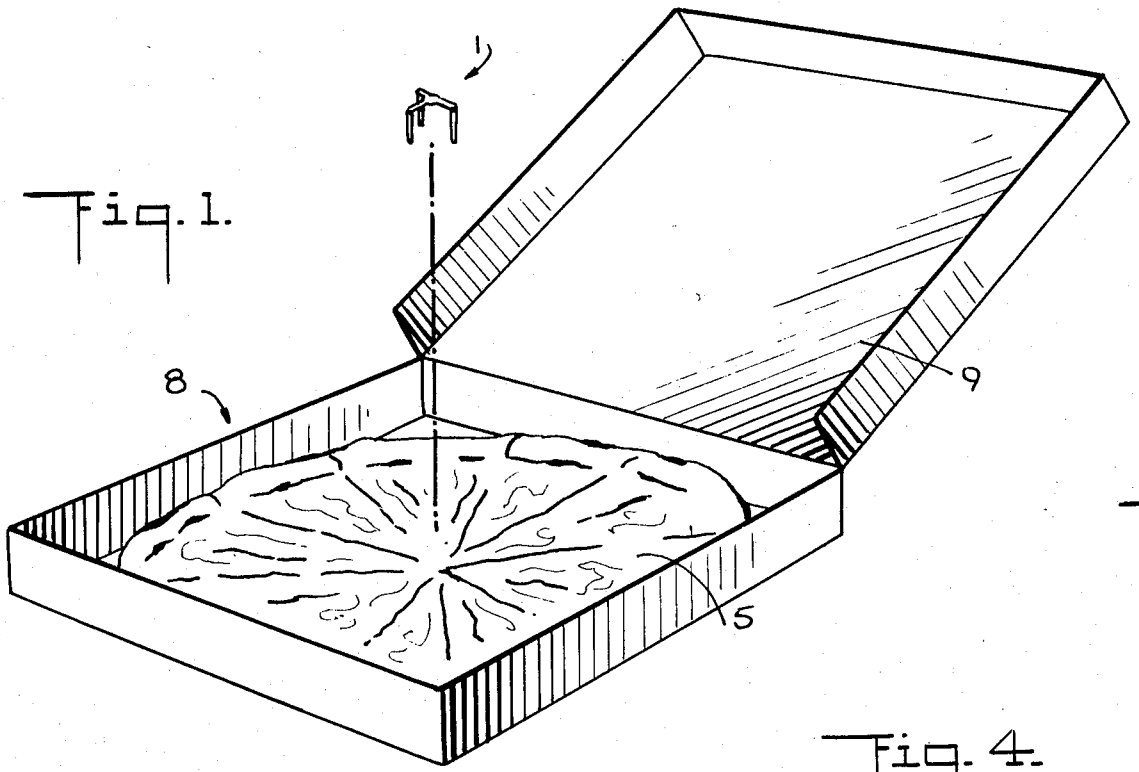
FIG. 1 is a perspective view illustrating the package saver being used with a typical pizza pie delivery box.
Figure 2:
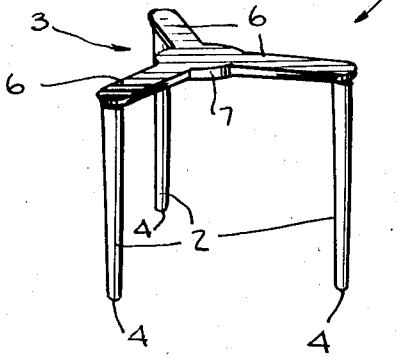
FIG. 2 is a perspective view of a package saver in accordance with the invention.
Figure 3:
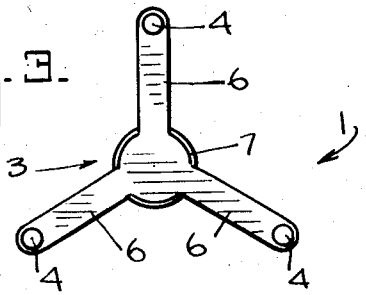
FIG. 3 is a top plan view of the package saver of FIG. 2.
Figure 4:
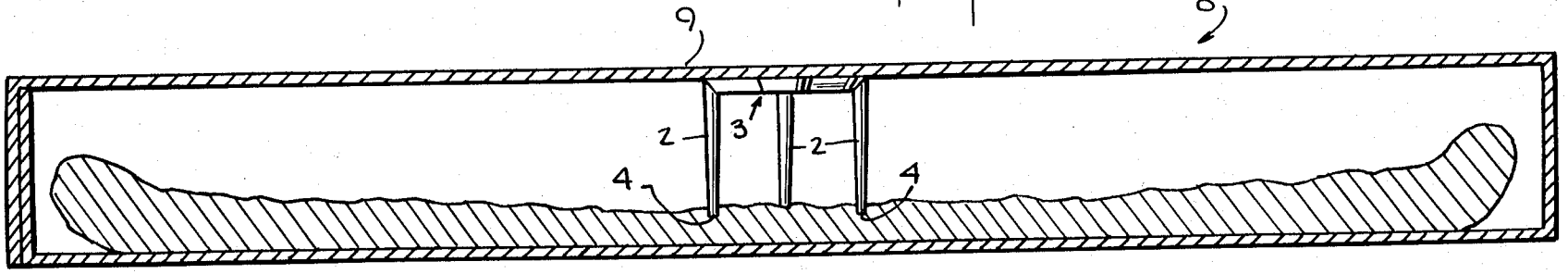
FIG. 4 is a vertical sectional view of a typical pizza box with the package or pizza saver in position.

In order to provide a lightweight and inexpensive device for the purpose discussed above, the saver is preferably molded as a unitary device from one of the plastics which is heat resistant such as the thermo set plastics and which will resist temperatures of as high as about 500° F.

In its preferred form, as illustrated, the saver 1 has spaced vertical legs 2 connected to a cover support 3. The lower portions of the legs 4 have a minimal cross section to minimize any marking of to the protected article 5 and they are also made thin for minimizing the volume of plastic required. The cover support 3 of the saver 1 also preferably has a minimum volume by consisting of a spoke-like arrangement of radially oriented leg supports 6 molded to extend from a central portion 7.

This construction of portion support 3 provides a suitable broad and stable support for box 8 cover 9 which is of minimal volume and thus has minimal cost. A disposable saver 1 is provided which may be used in the boxes or cartons without damage to the packaged pizza pie or other product.

As various changes may be made in the form, construction and arrangement of the invention and without departing from the spirit and scope of the invention, and without sacrificing any of its advantages, it is to be understood that all matters herein is to be interpreted as illustrative and not in a limiting sense.

Having thus described my invention, I claim:

1. in combination a package having a flexible cover, a food article packaged therein and spaced downwardly from the cover, a unitary molded plastic package saving device for positioning between the cover and the article for supporting the package cover thereby preventing damage to the packaged food article by the cover, said device comprising the combination of three or more spaced legs, each leg having one relatively flat end adapted for engaging the packaged article and having its opposite end attached to a device cover portion.

2. The combination as claimed in claim 1 in which said device cover portion comprises a number of flat cover sections radiating from a common flat central portion.

3. The combination as claimed in claim 1 wherein said device is formed of heat resistant plastic.

4. The combination as claimed in claim 1 wherein said device is formed of thermo-setting plastic.

* * * * *